US010814238B2

(12) United States Patent
Ireland

(10) Patent No.: US 10,814,238 B2
(45) Date of Patent: Oct. 27, 2020

(54) OVERLAY SPEED IMPROVEMENTS FOR A LAYOUT CONTROL SYSTEM

(71) Applicant: Anthony John Ireland, Lynn Haven, FL (US)

(72) Inventor: Anthony John Ireland, Lynn Haven, FL (US)

( * ) Notice: Subject to any disclaimer, the term of this patent is extended or adjusted under 35 U.S.C. 154(b) by 443 days.

(21) Appl. No.: 15/757,862

(22) PCT Filed: Oct. 16, 2015

(86) PCT No.: PCT/US2015/056051

§ 371 (c)(1),
(2) Date: Mar. 6, 2018

(87) PCT Pub. No.: WO2017/065807

PCT Pub. Date: Apr. 20, 2017

(65) Prior Publication Data

US 2018/0326314 A1 Nov. 15, 2018

(51) Int. Cl.
*A63H 19/24* (2006.01)

(52) U.S. Cl.
CPC ..... *A63H 19/24* (2013.01); *A63H 2019/246* (2013.01)

(58) Field of Classification Search
CPC .. A63H 19/00; A63H 19/24; A63H 2019/246; A63H 2019/30; A63H 2019/32; A63H 30/24; G05B 11/32
See application file for complete search history.

(56) References Cited

U.S. PATENT DOCUMENTS

| | | | | |
|---|---|---|---|---|
| 6,457,681 | B1 * | 10/2002 | Wolf | A63H 19/14 104/296 |
| 7,164,368 | B1 * | 1/2007 | Ireland | G01D 7/12 246/167 R |
| 7,471,649 | B1 * | 12/2008 | Kovach, II | A63H 19/24 318/268 |
| 9,937,430 | B2 * | 4/2018 | Kovach, II | A63H 19/10 |
| 2005/0285552 | A1 * | 12/2005 | Grubba | A63H 19/24 318/268 |
| 2006/0100753 | A1 * | 5/2006 | Katzer | A63H 19/24 701/20 |
| 2012/0016542 | A1 * | 1/2012 | Severson | A63H 19/24 701/19 |
| 2018/0326314 | A1 * | 11/2018 | Ireland | 19/24 |

* cited by examiner

*Primary Examiner* — Jason C Smith

(57) ABSTRACT

Methods and related apparatus embodiments are disclosed that allow combinations of legacy devices and new higher capability devices to be compatibly integrated on a model railroad control system to provide; higher system speed, new control capabilities and lowered control latency delays.

34 Claims, 2 Drawing Sheets

OVERLAY SPEED IMPROVEMENTS FOR A LAYOUT CONTROL SYSTEM

TECHNICAL FIELD

Figure 1:
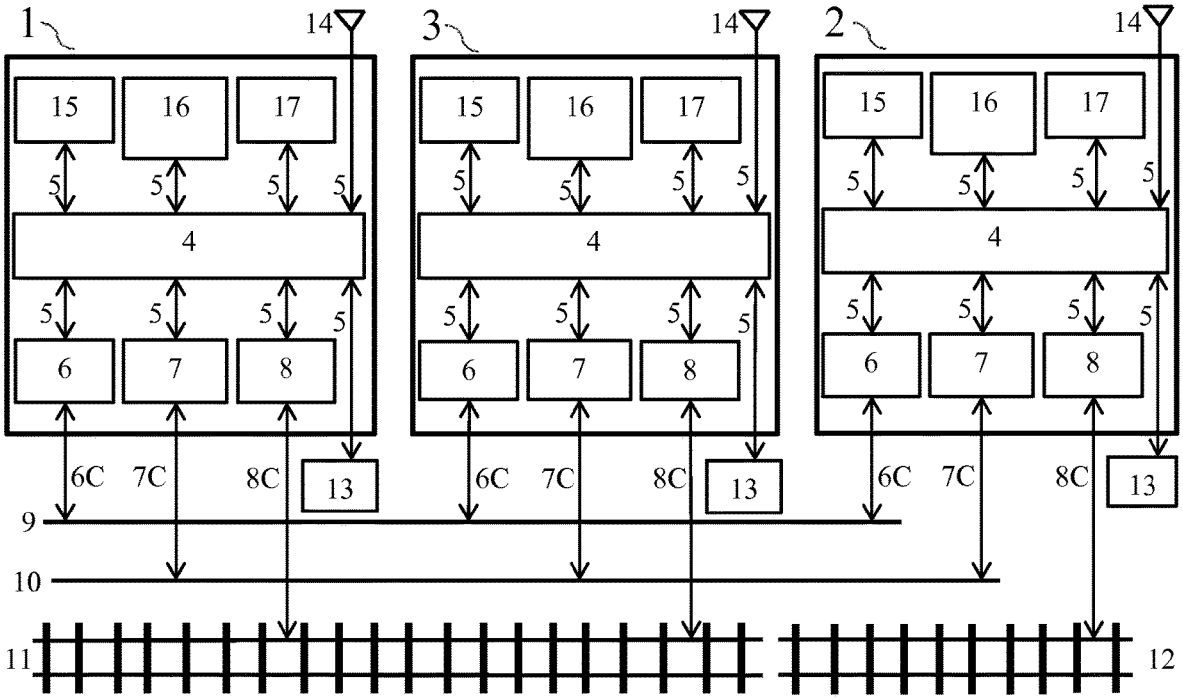

This invention is in the field of general integrated control systems and in particular for control upgrades on model railroad layout control systems.

BACKGROUND ART

Control systems typically gather and/or exchange data from information sources, process this source data using an internal algorithm or control logic method, and then convey and/or exchange the processed result to information sinks, to execute an action. As a control system implementation grows, sometimes organically, it will often require more resources, and in particular may require upgraded capability, to both; process a greater data exchange volume and/or do this at a higher net data throughput rate. This is true for digital scale model railroad layout control systems, as new and lower cost technologies become available that allow users to; assert faster and/or better control and operation of associated system devices, allow for new types of control features and layout operation automation, and other expanded control possibilities. The new art and method disclosed herein provides a method to seamlessly upgrade a control system such as e.g. a Digitrax Inc. Complete Train Control™ system (CTC system herein) or similar digital layout control system to enhance throughput, capacity and other key capabilities. Of great importance is the ability to overlay or "piggyback" these new capabilities onto an existing system in the disciplined manner taught herein. This ensures the majority of existing equipment investment retains full operating capability alongside any overlaid new additions that can then be configured so as to add the required increase in capabilities.

Prior art such as Ireland U.S. Pat. No. 6,275,739 shows examples of typical layout element names/functions and relative item numbers in brackets (nn) in FIGS. 1 and 2, and teaches two common topologies that are used for a layout control system for scale model railroads, or similar systems. These are based on controlled devices or information "sinks", such as items depicted in Ireland '739 FIG. 2; locomotives (10), signals (34), track turnouts (12), lights (14), smoke generators (15), animation controllers (17) and any other type of device that a user may wish to exhibit influence and/or control over. LAN (20) is equivalent to new art FIG. 1 data network 9. A controlling information or data "source" may be generated by any combination of manual or automatic input or control methods and/or devices, such as items depicted in Ireland '739 FIG. 2; manual throttle (1), sensors (5), switch inputs (6), auxiliary control program instances (19), etc. The most common system configurations employ a primary control unit (22) type of device [often called a Command Station] to generate electrical command signals in response to information source demands, and then conduct these commands as required to information sinks or controlled devices that may be connected to layout tracks for both power and/or command signals. The majority of system interconnects are by low-cost wire conductors that can carry both; varying information types and power. It is possible to also use e.g. wireless/RF, infrared or acoustic data links such Ireland '739 FIG. 2 item 16 to convey any information into, out of, and/or around different aspects of the total control system.

The instantiation of real hardware will typically force commitment to predefined particular protocols and/or modulation or control waveform(s) for information exchange, like; voltages or time dependent signal format and configuration for any system interconnection components of wired, or non-wires links (e.g. RF or IR link/optical cable, etc.). A protocol embodies all the required definition elements for fully configuring the; format construction rules, data and/or hardware formats, grammar structure and encoding and/or decoding formats of any waveforms with modulation, transmit bit timing, data timing and/or voltage levels, etc.

Examples of predefined protocol formats for the layout tracks would be a Marklin AC digital format, or the most widely-used US National Model Railroad Association (NMRA) Digital Command Control (DCC) format; a packet-based track power and signal protocol that uses an f/2f modulation method of full track voltage pulses (effectively ~9.6 Kilo-Baud (KBd) rate) generating 8-bit byte streams. A layout command control data network system example is the LocoNet® component of a Digitrax, Inc. CTC control system employing a 16.4 KBd (or kilo-bit/sec, KBps) rate CSMA/CD type of wired-OR multiple access multi-node network protocol. Herein, the ~ symbol denotes approximately, and uS means microsecond. Form 0xAB is hexadecimal representation of a 8 bit data value. The limiting DCC packet rate to the track is typically about ~150 packets/second (depending on packet length and complexity), so a LocoNet network that conveys at least ~200 messages/second can typically avoid being the primary information and control capacity bottleneck that overloads the system, or generates annoying user-perceptible control latency or delays, particularly on small and medium size layouts. In this discussion "packet" pertains only to track related information or waveform encodings, and "messages" are used for all other information and/or data exchanges in a layout control system. Clearly the track packets are a sub-set of the typical overall layout information source to sink data flows performing control and monitoring functions.

The increasing use of DCC type of control and increasing size, complexity and number simultaneous locomotives under active control can tax both the DCC and LocoNet speed capacity and/or control rates and hence degrade user perceived response time or latency. Other control and information source/sink activity such as Ireland '739 FIG. 2; signal control device (33) signals (34), sensors (5) and Signal ALM (32) can be used in combination on the local area network (20) [a LocoNet network in this example] for concurrent and independent processing to create a prototypically accurate layout signaling system that generates network activity and traffic that is totally independent of the DCC track sub-system and wiring. Other LocoNet or system activity that is not directly matched to DCC track packets may be wireless throttle connections, computer interfaces (WiFi, Bluetooth, Ethernet, or USB, etc.), and/or other information such as sound and image data exchanges.

For larger scale model railroad systems (in Z, N, HO, S, G or other layout scales) running with over e.g. 100+ moving locomotives, 100+ manual user throttles, and/or on layouts that may be over an acre in extent (e.g. >~4,2000 $m^2$), the DCC packet format is limiting for control latency, and the primary control unit (22) requires a new upgraded track control methodology to increase the net track packet rate or capacity. A track packet rate increase of 3 to 10 times would remove this as a latency or bottleneck problem on almost any practical layout, but the problem then becomes maintaining backward compatibility with existing track related hardware investments of; mobile locomotive and stationary track command decoders and the infrastructure of track waveform drive power boosters.

Prior art Ireland U.S. Pat. No. 7,164,368 is an example of typical system element names/functions and relative item numbers (nn), in FIGS. 5A, 5B and 5C, and teaches a track-compatible and suitable packet-interleaved and faster Phase Encoded Packet (PEP) waveform or track packet art that may be employed in between standard NMRA DCC packets. This follows the pioneering release of the Digitrax DCS100 Command Station or primary control unit in 1996. The DCS100 demonstrated the commercial practicality of interleaving or sequentially inserting track modulation formats or transmit-bit protocols such as DCC with both Marklin Mobile and Switch command control packets. A key to implementing the Ireland '368 art of FIG. 5C is the decoders' monitoring and compensation of the interleaved phase-encoded PEP waveform for track timing distortions. However, the Ireland '368 art is not the fastest and best performing upgrade art available for a track command encoding protocol, and the new art disclosed herein significantly improves upon this.

Many backbone LAN or networks such as Digitrax LocoNet employ a CMSA/CD multiple device access strategy to exchange information in the control system. The network speed and topology is determined by the maximum data exchange rates expected and/or required to be supported. In the extreme, one could choose e.g.; an OC48 fiber-optic network backbone transmitting at ~2.4 Gbps, Gigabit Ethernet or eSATA or Usb3.1/LVDS burst protocol etc., to ensure there is "always speed and/or capacity in reserve". This is clearly impractical in most cases, since all these high speed links and networks have limitations of; range, cost, complex connection hardware and support requirements, and are generally; not robust or architecturally flexible enough for typical sustained model railroad layout usage, particularly for users not technically trained to maintain hi-performance networks.

Some networks may employ a multi-drop common-conductor (versus star-hub) topology, and well known RS485, LIN or CAN control buses can be implemented as a CSMA/CD type network with single or dual balanced conductors that are logically wire-OR'ed, with sequenced tri-state drive or open-collector or drain type node drivers, and that share a common network pullup or termination. A network transmit bit-rate of e.g. 10 KBd to 125 KBd (a 8 uS/bit-rate) may be used, so runs of up to 170 m+ can be made on common telephone type Unshielded Twisted Pair (UTP) cables, wherein a typical cable ~15 nS/m propagation speed results in an open-circuit far-end voltage reflection settling before a bit time completes, so as to minimize Inter-Symbol Interference (ISI). With CAN bus type technology it is important that terminations and/or transmitter impedances are configured to suppress these transmission line reflections, and this constrains interconnection flexibility and adds possibility of unpredictable errors if care is not taken in network; construction, modification and maintenance.

A LocoNet network employs a single-ended open-collector/drain wired-OR topology with a single current-source termination, with a rest or marking-state of ~+12V DC. The legacy LocoNet bit-rate at 16.4 KBd is about 60 uS/bit in a Non-Return Zero (NRZ) Asynchronous (Async) format with 8 serial data bits grouped as a data octet. The arbitrary octet 8-bit data-grouping name (for a data byte) is to underscore there is no required one to one correspondence required between LocoNet message octet data and e.g. formatted DCC packet bytes of a track drive subsystem. The LocoNet architecture allows great free-form flexibility in connecting multiple and varied parallel wire runs and connection taps, and total length of parallel conductors can be extremely long (e.g. over >330 m). The limiting factor at this managed bit-rate and using a common current source pullup/termination is the signal rise-time due to the combined cable capacitance. With e.g. ~330 m+ of UTP Cat-3 cable, the full swing rise time is in the approximate range of ~12 uS to 15 uS, which at ~25% of the bit-rate, avoids data errors. Conversely, the NRZ signal fall time is less than ~1.5 uS, with possibility of worst case transmission line reflection effects giving an edge uncertainty of ~1 uS and possible brief negative undershoot at ~2 uS. The actual rise and fall waveform shapes encountered differ depending on where a device connects into the wiring, and the design is configured to cope with a range of waveform transition shapes and timings.

The original or legacy LocoNet data rate was chosen to complement and exceed the fundamental DCC packet/command rate, and to be as slow as practical for operational and configuration robustness. LocoNet message encoding formats, rules and access logic are arranged as Peer-to-Peer and event driven, to provide the best possible; information rate, data exchange efficiency and/or message latency characteristics. LocoNet message octet counts typically are more compact and/or coded so as to be more efficient and less than the derived DCC packet bytes that result from any data changes, which are what actually generate or encode information content destined for information sinks in an information theory (IT) sense. Only packets that encode state changes actually contain information, and the repetition or refresh of all locomotive states is effectively redundant and for provision of track energization, except in the case when track noise and/or power interruptions disrupt packets, wherein the packet refresh or repetitions allows faster decoder recovery.

Clearly, if the track packet rate (and/or effective bit-rate and packet rate on this e.g. output link) is increased to improve track control capacity, then a complementary increase in the LocoNet (e.g. an input link) speed for supporting an improved e.g. DCS100 Command Station or primary control unit is sensible, to provide a unity of embodiment of the concept of this new art. The key is to realize the main goal; as a backwards compatible overlay upgrade path that (as much as practicable) preserves function and investment in existing LocoNet connected legacy devices while allowing greater network capacity, faster transmit-rates and packet rates, and allowing for new and expanded types of control and information/data exchange capabilities symmetrically via both input and output links.

DISCLOSURE OF INVENTION

Improvement of the operating speed and hence number of simultaneously supportable devices and reduction of perceived task latency of an existing and/or new installation layout control system are some of the goals of this invention. Additionally, a maximum level of backward compatibility on existing legacy; wiring, equipment and infrastructure investments is a further goal of this invention.

Speed and capacity improvements are added in both the; overarching control system network and in the track control sub-system that are used to improve net system information flow capacity and rate. Any device employing this new art may employ this invention on either or both aspects of the control system on the network or track aspect, since they are strictly complementary and required in the best practice of overall system speed and capacity improvement. Some devices may not connect directly to the track and only use e.g. a network connection speedup, but are still intimately involved in the net result that requires and employs an improved track control rate capability. These improvements may be employed with coding schemes and network configurations other than the specific DCC and LocoNet embodiment examples given, adjusted to meet any small technical differences but keep the same logical process as this new art. Information background on the DCC Standard can be obtained at www.nmra.org, and LocoNet protocol and format information (incorporated by reference) can be seen at www.digitrax.com, web sites.

A minimum defined 3-byte DCC packet, following the nominal rules is a NULL: {sync},{0xFF=(address)},{0x00=(reset command)},{0xFF=(ECB)},{packet end},
and this comprises 28×116 uS '1' bits, and 10×224 uS '0' bits, for an ~5,488 uS packet duration. This is the shortest possible 3-byte DCC packet at the given bit times, and only conveys a net 16 bits of data [as a 'Reset' command to 8 bit address 0xFF], since only the first and second bytes are data significant, and all other bits are protocol overhead. This gives an approximate coding efficiency of 343 uS/bit for this shortest NULL DCC packet, which just consumes coding time. This efficiency is dependent on the actual packet length and active or non-error control byte (ECB) byte count and ratio of 1's to 0's in the actual data payload. DCC '0' bits are costly in terms of lost data bandwidth or coding efficiency in time. In this context for DCC coding rules, all DCC bits are split into a front and back part called 'cells', for convenience herein. A cell is a time period defined by alternate polarity voltage change edges of a signal waveform being decoded or encoded.

This shortest DCC NULL packet can simply be followed by an Ireland '368 FIG. 5C prior art PEP waveform. Since; track transitions are typically in range of ~1.5 uS to ~4 uS, Ireland '368 allows any track decoding device to measure and calibrate any PEP track level or timing distortions. Modern and inexpensive microprocessor software and/or hardware can measure time to better than ~100 nS resolution, it is thus possible to phase encode and decode a track transition cycle in selectable increments of e.g. ~2.5 uS to ~5 uS time steps or phase increments (quanta), or shorter.

To keep a fastest net track transition cycle at the same rate, and RF emission defining pulse repetition rate (PRF) as the nominal DCC signal, we could choose a minimum high and low period of about 3× track slew time, or e.g. ~12 uS at start and end. This leaves a phase encoding range across a front and back cell pair of 116 uS−(2×12 uS) or ~92 uS. Choosing a ~5.75 uS phase encode step/increment (92 uS/16) allows resolution of 16 phase coding steps or a 4-bit binary bit alphabet encoding, whereas the DCC signal only carries 1 bit in the same time. A slightly faster 2.875 uS phase increment would give 32 levels of quantization or 5-bit binary encoding, and a ~5× instantaneous coding rate-gain or throughput over a nominal DCC '1' bit.

Using an example 224 uS long DCC complete '0' bit coding cycle, the coding improvement for an available ~100 uS phase range is ~35.08 phase steps of 2.875 uS increments. This can be adjusted for convenience to e.g. 32 phase coding steps of 3 uS over a 96 uS range, or 5-bit binary coding per DCC '0' time, or a 6 bit total encoding capability in a single DCC '0' bit. So, the Ireland '368 PEP art can simply and backwardly compatible improve on DCC throughput by a typical factor of e.g. ~5+ times, whilst keeping the existing; track booster, wiring, and existing DCC decoders operating on wholly prior art compatible signals. Interleaved PEP packet edge timings may be configured at extreme values so existing decoders reject these as violating the DCC timing and/or protocol criteria for a correctly formed packet, and simply await a compatible DCC packet they can decode.

Note that IT teaches a typical logarithmic relationship between event probability and information content/source entropy, so a halving of the bit coding phase step/quanta in this example only yields a ~25% improvement in bit-rate or coding rate-gain. This tends to define the sensible choices in engineering compromises for a robust design in the presence of time jitter and noise.

In this way an example e.g. DCC NULL packet of ~5,488 uS delivering just 16 data bits can be followed by a separate interleaving Phase Encoded Packet (PEP) of e.g. 5,488 uS (assuming similar protocol overheads) that delivers ~5× or 80 bits of data in the same, but consecutive ~5.4 mS elapsed time. Note this interleaved PEP can have a different or faster bit-rate than DCC, and this one example simply is configured to ensure that it is backwards timing compatible to DCC and/or any other selected interleaved track protocol(s). Ireland '368 prior art only teaches interleaving or interspersing phase encoding protocol packets, in addition to optional e.g. Marklin AC/Trinary, Trix, FMZ etc., protocol packets, between existing streams of DCC encoded packets.

The new art PEP now further allows any phase encoding protocol improvement to also be additionally applied (also with modified encoding ranges) to a prior packet and/or any track format and/or DCC packet itself.

This now allows this example's prior ~5.4 mS NULL packet to carry a further e.g. ~80 bits of data, allowing a total of 80+80 or 160 bits of new art data, along with 16+16 bits of standard DCC data in: 5.4 mS+5.4 mS or ~10.8 mS for the two sequential packet times.

This gives this new art method an approximate bit-rate of 192 bits/10.8 mS or ~51 uS/bit capacity (depending on encoding times and rules), since now both 5.4 mS example durations can carry some selected combination of DCC and simultaneously merged or continuously overlaid PEP packets, in all of the possible example 5.4 mS baseline and consecutive DCC packet time periods. This new art invention can almost double the Ireland '368 average coding rate-gain and track packet throughput improvement over DCC and/or any track format, exceeding what was taught or claimed in the Ireland '368 prior art. This PEP new art effectively merges two simultaneous command control streams into one composite track modulation waveform or format.

As taught further in this new art, these approximations can be modified by some new art selective rule changes to DCC bit and packet protocol encoding/decoding, improved packet coding rules and structural synergies that allow 100% backward decoder capability, in most variations. Old art decoders will still operate, but new art decoders employing new art overlay PEP capability packets and protocol rate-gains can run on the same layout with; increased numbers of locomotives, significantly improved bandwidth, lower response times and decreased latency. These examples are simply illustrative and may not represent a best case or limiting engineering implementation and/or configuration and embodiments of this new art full overlay PEP packet method for practical track data flows and system usage.

One can consider this new art PEP packet overlay as a time continuous (versus interleaved), parallel and ~five times faster control channel that can be selectively used, and that is fundamentally configured to be fully compatible with existing DCC track connected equipment. Additionally, since the track waveform is a fixed full swing at similar cell rates, the generated/radiated noise RF and EMC harmonics are very similar to prior art DCC at the same pulse repetition frequency (PRF), and phase encoding tends to generate wider and lower rate smeared sideband phase modulations around the same predominant carrier and harmonic peaks, fundamentally set by just the waveform PRF. Slew rates are generally controlled and limited since the faster slew rates tend to generate a higher amplitude and more persistent series of higher harmonics.

A standard or legacy 16.4 KBd LocoNet data network can run a layout where the packet generating functionality and timing located in e.g. the primary control unit has been updated to permit overlaid PEP track coding speed improvements, since the faster refresh of track packets does not require any network message bandwidth. If a USB connection to e.g. a PC/computer is provided directly into this primary control unit, then PC control over the USB at rates of e.g. 1 MBps and/or 12 MBps etc. can keep up with this improved PEP track throughput, by selectively not conducting all this data onto the slower legacy LocoNet infrastructure. In most cases it is preferable to also upgrade LocoNet speed in a complementary manner so existing and new art devices can be mixed and allow net overall system speed improvements. To do this with e.g. existing wiring infrastructure, requires new devices with the prior art (STD-LocoNet) transmit-rate driver circuit updated to allow selective rise time speed up. With faster rise times, it is now possible to selectively transmit LocoNet messages at a preselected higher (HI-LocoNet) transmit-rate such as e.g. 7 uS/bit (142 KBps) or an ~8.6 times increase in nominal octet rates on the majority of existing wiring, which is as good or better than PEP coding improvements. A bit-rate reduction to e.g. 7 uS allows new HI-LocoNet devices to work at high speed but is not sufficient for compatibility and interoperation of legacy/STD-LocoNet devices in a sequentially mixed transmit-rate octet and/or formatted message operating environment, required to protect investments in these otherwise functional legacy devices. This disclosure teaches novel and required new art; message coding, operating rules, timing and technical changes to ensure a novel mixed speed rate HI/STD-LocoNet can be implemented successfully with best throughput.

These PEP and LocoNet new art speed improvements can be applied selectively to the track and network connectivity aspects of the overall layout control system functionality, independently for asymmetric improvements or in a preferred synergistic and interrelated combination. A key to these improvements is that the new art is configured to be added as an overlay and/or upgrade so as not to interfere with legacy devices exchanging data on input and/or output links with earlier protocol variants, or other different protocols and/or formats. A new art overlay of mixed HI/STD-LocoNet can be implemented without updating to overlaid PEP track coding speed improvements; since the track control aspect is merely one subsystem of the total control system, and other functions like e.g. layout detection and signaling can benefit from improved network speed, without directly impacting or requiring faster PEP track packet rates. The overlay upgrades taught herein modify data transmit-rate and/or protocol formatting rules and encoding construction and/or methods, as needed to improve data exchange rates, whilst also allowing concurrent unmodified operation of legacy protocols and devices. This is wholly unlike data network speed upgrades, and/or variable rate connections like 10/100/1000 BaseT Ethernet or USB 1.0/2.0/3.0 port connections, because these wired links to a specific device initially establish a negotiated or predefined point-to-point rate that this single device connects on, and this rate does not change during a connection session. It is actually counter-intuitive to run different transmit-rates intermixed on an existing multi-drop link and control system because of the added complexity to support different mixed transmit-rates, and this new art is employed so it is possible to mix legacy devices alongside new devices on legacy wiring and/or infrastructure.

BRIEF DESCRIPTION OF DRAWINGS: (2 SHEETS)

All drawings are not to scale, but are detailed with many optional embodiment features, for illustrative purposes.

FIG. 1 details three schematic examples of layout control unit devices and items that may be logically and/or physically interconnected and associated with a control system.

Figure 2:
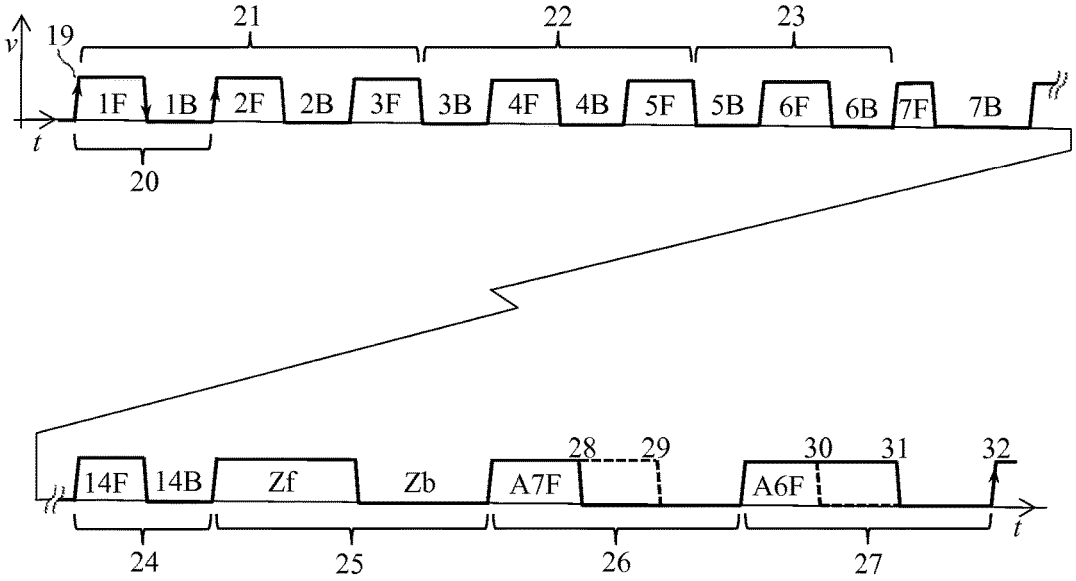

FIG. 2 details an example of a time varying DCC protocol waveform in the vicinity of a packet start SYNC region with features that allow the overlay of an embodiment of a phase encoded (PEP) protocol.

Figure 3A:
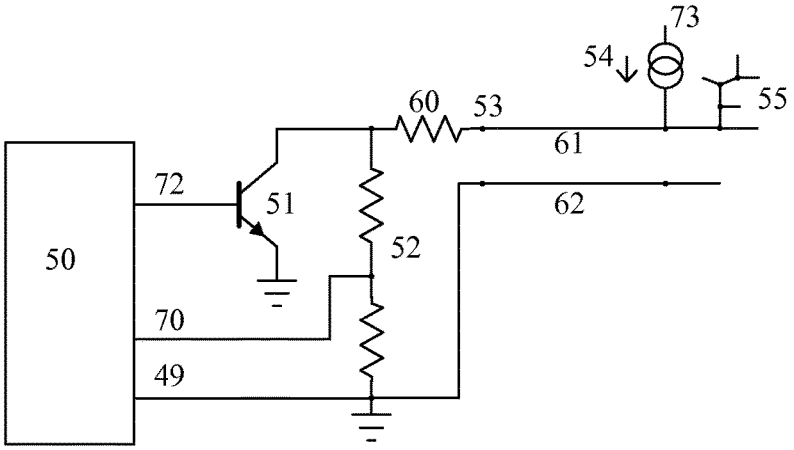

FIG. 3A details a single-ended wired-or (multiple access) example of a wire connection to a multi-drop network with a current source pullup termination.

Figure 3B:
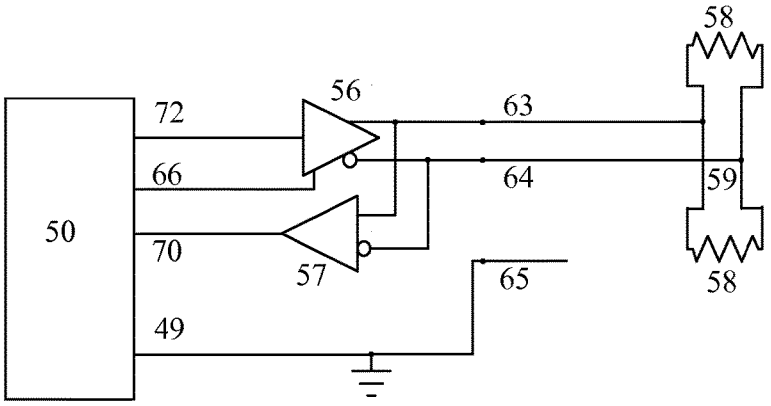

FIG. 3B details a differential wired-or (multiple access) example of a wire connection to a multi-drop network with a resistive impedance termination.

Figure 4A:
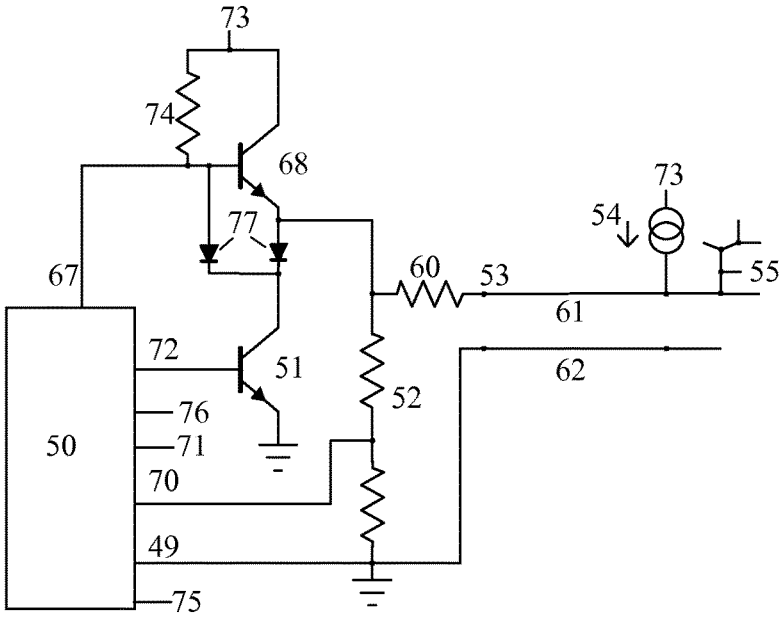

FIG. 4A details a single-ended wired-or (multiple access) example of a wire connection to a multi-drop network with a current source pullup termination, with new art embodiments for; network compatible rise time and transmit-rate speedup using gated transmit source current augmentation, and ability to monitor operating signals for diagnostic use.

Figure 4B:
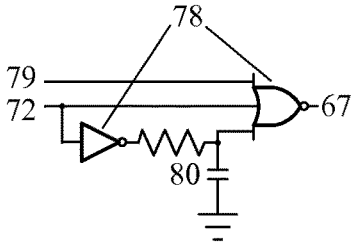

FIG. 4B details one possible example embodiment of improved logic for controlling transmit source current speedup that uses well known logic elements and a resistor/capacitor time delay network to generate a combination of timed source control gating and/or enabling pulse voltages.

MODES FOR CARRYING OUT THE INVENTION

Primary control unit 1 of FIG. 1 item 1 (herein also 'Command Station') represents a system control device means configured to be interconnected in a system that may include unidirectional and bidirectional data link means; track connection 8C to primary layout tracks 11 as a predominant data sink, and/or other connections or links to information/data sources. Primary control unit 1 is broadly comprised of; an implemented control unit logic 4 that animates, sequences and configures 1 to perform any predefined primary control task(s) required, based on setup data obtained from configuration storage 15 means, and instances of internal data exchange path 5 means connecting to other logical component means, such as; data network interface 6, power interface 8, auxiliary control interface 7, protocol codecs 16 and extra data connection 14. The functionality of each of these component means is performed by associated and combined hardware and/or software elements. All the control sequencing and logic may be combined into a single multitasking control program or software running on a single CPU/microprocessor or FPGA etc., but that is not a requirement, and a number of these component means may have separate CPU and software instances that functionally exchange/communicate data and/or state information via an internal data exchange path 5 instance. The item 1 software and logic combinations residing in e.g. Flash EPROM or FPGA etc. may be downloaded and/or updated as needed by an Initial Program Load (IPL) method via any suitable communications connection that is configured to allow for and manage an IPL task.

Data network connection 6C is a bidirectional or unidirectional data link that conveys formatted external requests, for controlled changes in e.g. a locomotive on the tracks, from e.g. user throttles or attached PC's (not shown, for clarity) via data network 9 through data network interface 6, which are decoded and validated into a data buffer by a format-matched sub-function or instance of protocol codecs 16, and available to control unit logic 4 for processing. The decoded data buffer is interpreted and stored as state and control information related to a controlled device, and at an appropriate time this change result may be sequenced to be encoded by an encoding aspect of protocol codecs 16 into a suitable track control protocol packet signal. These derived track control protocol packets are buffered and amplified by power interface 8, and resulting differential or bipolar single-ended drive waveforms are conducted to primary layout tracks 11 via track power connection 8C to control and/or power devices. These protocol packets may be optionally buffered and output by auxiliary control interface 7 via auxiliary control connection 7C to auxiliary control network 10. The current state information associated with an addressed object like a; locomotive, signal, turnout, sound generator, lamp etc., may be stored and retained internally inside 1 by control unit logic 4 or any other control task, as needed. Auxiliary power device 13 may be present and can be used for example as a programming track. Additional operating information such as voltages, detected fault conditions and/or alarms and operational statistics are measured, collected and then stored in interface status storage 17.

Control unit logic 4 orchestrates the logic that infers what type of processing may be required for any types of input information and data/state changes and the matching formats used on any data links. For track control, this processing decides the required one of many possible track protocol(s) and combines this with the modified data as an input to protocol codecs 16 that encode or generate the needed track control protocol signal packets and timed waveform to ultimately drive and/or control devices on the tracks. Users can specify which available track control protocol and/or format to use for any addressed locomotive or controlled device decoder that implements the protocol decoding process and executes an action as directed by the protocol encoding grammar or construction rules/algorithm. Since PEP encoding is faster than DCC, for best performance it is useful to employ an algorithm to identify and remember within the system any PEP capable devices and ensure that this preferred PEP protocol is used for them by default. In this scenario a non-PEP protocol can be manually overridden if needed on a device to device address basis.

One or more extra data connection 14 (e.g. WiFi/RF or InfraRed/optical data links) may be used for a primary control input as unidirectional and/or bidirectional data interface links independent of data network 9, and generally it is best practice to echo messages and data both ways as possible between these two data source items so data and state synchronization is maintained throughout the control system. An additional special case of 14 would be an optionally galvanic/optical isolated USB interface to a PC, since this connectivity is not through data network 9, but is a separate data connection with a possible wire component.

Secondary control unit 2 means (herein also 'Booster') can be a replica of primary control unit 1, but is configured by its local instance of configuration storage 15 and control unit logic 4 to operate as a slave control or Booster unit that accepts a mirror copy of the active track protocol waveform from 1 over auxiliary control network 10 link (may be known as a bidirectional 'RailSync' interface) via an auxiliary control connection 7C and auxiliary control interface 7. This information is then amplified by its' power interface 8 and resulting waveforms are conducted to the secondary tracks 12 via a track power connection 8C. In this example, primary control unit 1 is functioning as a Command Station and 2 operates as a Booster.

Item 2's protocol codecs 16 may now be employed to decode track commands and actions to execute from auxiliary control network 10, independent of or in conjunction with data network 9 activity, and any e.g. locomotive derail fault on primary layout tracks 11 or track 12 that may briefly short out the track signal and transiently defeat track use for commands. Instances of one or more protocol codecs 16 exist in some form in almost all associated layout control devices to allow for; encoding and/or decoding and validation of network protocol messages and formats such as e.g. LocoNet messages from any data network interface 6 via an internal data exchange path 5, auxiliary and track packet protocol waveforms, and any other signals and data formats used by the device. In most cases this encoding and/or decoding function logic is implemented in some manner and may be employed as required on any data formats and their associated rules and structures or grammar. Whilst a LocoNet network protocol message and a resulting DCC packet have outwardly vastly different; bit transmit-rate, waveforms, formats, encoding methods and construction rules/grammar, they are logically and closely interrelated as different aspects of information and actions flowing from an information source to sink. Data flows via codecs may be between any combinations of input and/or output link(s), in available input and/or output directions and in different encoding and communication methods as required. The codec and related control logic can also act in a; decode, store and forward manner as required.

Protocol codecs 16 may exist as an abstract section of logic in the overall software and/or control hardware logic, and are identified by their encoding and/or decoding capability implemented to process data and information between different representations and/or transfers across data paths from information sources to sinks The term codecs, as meant herein, in plural specifies a functional means or module that can encode and/or decode one or more protocols and/or formats, and may also not be symmetric in that they may only implement just the decoding or encoding function of an included protocol.

Secondary control unit 2 one or more protocol codecs 16, decode formatted data as LocoNet protocol grammar messages by scanning UART receive octets at a matched bit-rate, looking for an octet with most significant bit of 1 as the rule signifying a message start octet or opcode. Decoding of this grammar continues by inspecting this opcode to determine encoded message length. This opcode and following data payload octets, until expected message length is met, are stored in a queue or data buffer, and then a final error checksum octet is evaluated to ensure this completed receive message is valid, which completes format and grammar rule-check and decoding. Any violation of the; data framing, grammar or construction rules leads to message rejection for that bit-rate UART channel, and reception process restarts based on error handling rules, waiting for correct bit-rate data. The messages of non-legacy bit-rate data are configured so an instance of a UART receiver at the wrong bit-rate will yield no message, whilst a parallel correct bit-rate UART will detect the message properly. Herein 'bit-rate' may be contracted simply to 'rate' or 'transmit-rate', as the characteristic of a serial communication stream rate set by a data transmitting means on a data link. In this manner the decoding function validates and unpacks input messages of LocoNet format octets and converts these into an internal data buffer representation for further processing by control unit logic 4. After codec processing all valid mixed rate messages exist as collections of stored decoded output data in buffers. Since control unit logic 4 can now access any of these stored data buffer combinations at the same CPU speeds, the original characteristic transmit-rate of any valid message from an input link does not constrain further data processing. To send valid LocoNet format messages, a secondary control unit 2 employs a symmetric inverse form of this decoding algorithm or method to encode a LocoNet format message octet stream from data in a data buffer for transmission to; data network 9 and/or extra data connection 14 etc.

Secondary control unit 2 protocol codecs 16 can decode formatted DCC protocol grammar packets by accumulating edge/cell timing events from e.g. auxiliary control network 10 signals, and scanning for a SYNC edge/cell pattern of at least eleven consecutive 1 bits. SYNC bursts end with the first encountered '0' value byte-start bit and the next 8 bits then encode a first address function byte. Subsequent bytes are decoded using the common DCC grammar/format and rules, with each byte boundary being flagged by a '0' byte-start bit. The first '1' byte start bit flags that the last byte was the packet end and error control byte, and if this ECB for the packet is correct then the queued bytes are flagged as a good packet received, matching DCC grammar and encoding rules. Here the codec decodes a formatted DCC packet and converts the data into an internal buffer or queue for further processing by control unit logic 4, such as using a switch command to modify an internal state, etc. The symmetric reverse of this decoding procedure may be implemented in protocol codecs 16 if secondary control unit 2 is required to encode data into alternate DCC packet commands and transmit them alternately on e.g. secondary tracks 12.

Only one instance of 1 operating as a Command Station can be logically present on a layout, but multiple instances of 2 may be configured to power different areas of the layout to; increase power capacity and short circuit tolerance. Instances of 2 can also selectively encode locally different track 12 protocol waveforms differing from auxiliary control network 10, at direction of setup commands from data network 9 and/or extra data connection 14. To improve system setup reliability for e.g. a mobile and transient modular type layout, when the control system initializes, all instances of 1 (and/or 2) can probe data network 9 with a message that only a Command Station will respond to, thus identifying its presence. In this case, if 1 detects another Command Station, it can employ a priority algorithm to write back a Configuration command over data network 9 that forces all other Command Stations to update their local configuration storage 15 to exit Command Station mode and become simply a Booster. This same logic can work in reverse in that if a Booster configured 1 initializes and does not detect a Command Station, it can automatically change local configuration storage 15 to enable this mode. These types of security measures can be selectively inhibited by other setting data in configuration storage 15.

Tertiary control unit 3 (herein also called a 'Decoder') is configured with most of the same functional items as 1 or 2, but its local instance of control unit logic 4 configures it to operate as a protocol decoder that mostly executes commands, effectively becoming an information sink. If tertiary control unit 3 has; a data network connection 6C it can accept network commands, an instance of auxiliary control connection 7C allows reception of track commands, and an instance of 14 allows the option of non-wire or other commands. Configuration storage 15 in 3 predefines how to prioritize and/or accept commands from any of these possible differing rate sources and interpret them using protocol codecs 16. If 3 has only a track power connection 8C as an input, then it can operate as e.g.; a mobile and/or locomotive decoder or a stationary decoder. Auxiliary power device 13 here drives e.g.; a motor, lights, loads or sound outputs, etc. as required for its defined functionality.

Instance(s) of tertiary control unit 3 have possible connections to any and/or all of the input and/or output links, like; data network connection 6C, 9, 10, 11, 12 and 14 etc. If auxiliary power device 13 on an instance of 3 is reconfigured as a user input and display means, then its control unit logic 4 can be configured so it functions as e.g. a throttle input device. This underscores that most system control devices, whether operating as information sinks and/or sources, have a number of very similar logic and/or hardware control blocks or software modules that are design-reuses, and that operate in a very similar manner in different parts of the control system. An example of a combined information source and sink functionality is e.g. a Digitrax Inc. DS64 Stationary Turnout decoder that can encode user input button-press closures into LocoNet messages and/or route commands (a source), and can simultaneously also decode LocoNet message or 'RailSync' link DCC turnout (a.k.a. 'switch') commands to change turnouts it drives (a sink).

New devices can be configured to only process HI-LocoNet protocol messages and thus will only exchange data with other HI-LocoNet devices, whilst other connected legacy STD-LocoNet devices will only exchange slower STD-LocoNet messages, with both speed rate messages interspersed sequentially on the same physical LocoNet wiring. This proceeds without interference because the new art HI-LocoNet protocol format encoding rules, codecs and/or hardware/software embodiments are configured to allow this multi-rate interoperability. The number of interconnecting data links (e.g. 6C, 7C, 8C, 14 etc.) employed by each hardware embodiment like 1, 2, and 3 may be different, whilst still employing similar instances of logic for 4, 16 etc. An interconnecting data link like 6C, 7C and/or 8C can carry mixed encoded byte and/or bit formats of different protocols, and it is the function of control unit logic 4 in combination with one or more instance of protocol codecs 16 to correctly and/or compatibly detect and decode/encode the actual data format used, and validate the received data for further processing. Invalid data formats and protocols are typically ignored.

The Command Station may be configured to operate in a limited-master mode so an external PC on extra data connection 14 (e.g. USB interface to a PC) overrides the layout control sequencing and now uses this primary control unit 1 as just a communications hub and codec to all the connected layout data links, layout tracks, and/or storage for state and configuration data. In this configuration other extra data connection 14 links to instances of secondary control unit 2 may be "concentrated" to this and/or another PC and this then acts as a logical bridge to combine and control data flows on different segments of LocoNet and tracks with a greater overall processing capacity that is not limited by any one LocoNet and/or track capacity.

FIG. 2 is a voltage-time representation of an example DCC track waveform in the packet start SYNC region that has an overlay of new art PEP protocol encoding. For clarity it is shown as unipolar, but the actual voltage levels and polarity seen depend on the observers reference point. The last bit of the DCC packet ECB byte is shown as the voltage rising edge at 19. Since the track waveform is full swing from a maximum negative to maximum positive voltage, it can be seen in either polarity order depending on which rails the two decoder leads are connected to. In this example all DCC bit back cells end with a rising edge from lower to higher voltage, equal to the voltage employed for the scale in use. A mobile decoder running on this track in the opposite direction will see a voltage mirror image of FIG. 2, but still be able to decode the protocol because DCC information is encoded by the voltage change edge timings and not actual voltage polarity or amplitudes. The DCC Packet End bit 20 ends on a rising edge and encodes in time a '1' or shortest bit, which indicates the prior byte was the ECB/last packet byte and the protocol is entering a SYNC window of all consecutive 1's. This End bit 20 here is framed by two rising edges and the first high half is represented at front 1-cell item 1F and a low back 1-cell item 1B, both 58 uS nominal. DCC Command Stations must send at least 14 SYNC 1's in series, so SYNC End bit at 24 is shown as composed of front cell 14F, and back cell 14B ending on a rising edge. Packet Start Bit 25 encodes as a '0' bit, as a 112 uS zero front cell, item Zf, and a 112 uS Zero back cell item Zb for a total of 224 uS for the '0' bit.

Primary PEP reference burst 22 includes four 1-cells, 3B, 4F, 4B, 5F and these are nominally fixed at e.g. 58 uS each (arbitrarily matching DCC '1' timing), as an area without phase coding that allows a decoder PEP protocol codec function to determine any instantaneous phase jitter and/or offsets, by measuring the actual received time durations of these 4 fixed cell widths. These 4 time periods allow the variation of 2 rising edges and 2 falling edges (i.e. two high and 2 low cells) to be measured and derived phase reference corrections can be applied as (in +/− microseconds) to following detected PEP protocol data bits. This phase calibration or correction also allows the decoder to develop a continuous transmission reception quality measurement as shown by the changing values of phase reference corrections, and these values can be stored by the decoder and/or control device for e.g. the Command Station and/or system to recall, so the track signal quality can be monitored in real time as needed. A lower value of jitter and phase/time offset is better, and the difference of these reference cells timed relative to an e.g. 58 uS reference cell indicates how the rise time and system delays are distorted or unbalanced.

Time or phase differences from these reference cell times are adjusted as the nominal PEP time and applied as time corrections to PEP cell times to extract a best estimate of the sent phase value and hence intended phase coding value. This removes time and offset biases from the PEP bits in both polarities and cell voltage levels. For example if both low level reference cells (i.e. starting on falling edges) measure at ~56.75 uS, then we know that low level PEP code/time value should be adjusted by 58 uS−56.75 uS=+1.25 uS, or by an average of the differences. Similar adjustments should be applied to the high cells using the high reference times, and the total of consecutive high and low reference 1-cells should be e.g. 2×58 uS=116 uS (+/−~200 nS) in this region, if the system is stable and jitter is well controlled. This is a useful quality metric to monitor, and excess and varying jitter will require the phase steps to increase in time value to maintain coding reliability, and a decreased number of steps will decrease the coding and/or rate-gain.

Item 22, at minimum, includes a front and back 1-cell to evaluate both edge characteristics, and can be located anywhere convenient in an underlying DCC packet. This example location of 22 is chosen for decoding convenience as matching a track data-feedback method, such as Ireland U.S. Pat. No. 6,220,552. In this example, an Ireland '552 based Digitrax track data-feedback Transponding ID 'ping window' for DCC packets occurs as feedback pulse trains in four consecutive 1-cells in this exact bit window, and this configuration of 22 maintains 100% legacy data-feedback compatibility. To simplify the time critical decoding function in a codec, an optional cell phase coding holdoff period 23 is included at cells 5B, 6F and 6B that do not have any phase encoding (e.g. nominal 58 uS 1-cells) and these can be skipped from any phase processing while the ping edges of 22 are being evaluated and the; phase offsets, jitter, and signal quality are evaluated. Normal encoded SYNC 1-cells resume at cells 7F and 7B, shown with minimum 7F front period, giving a minimum PEP phase time encoding for 5-bits, the first of 32 PEP steps of 2.875 uS. For best performance a PEP reference signal created by any protocol codecs 16 should have timing and/or phase jitter errors less than, e.g. <10% of fastest track voltage slew rates, or ~150 nanoseconds. Now, subsequent hardware will distort and degrade this at track power connection 8C and auxiliary control connection 7C, based on; line condition and/or loads, temperature and semiconductor component performance, etc.

All Transponding function current pulses are normally completed by end of cell 14F, so if full Transponding track data-feedback compatibility is desired, the window period from 6B to 14B should have a maximum phase coding change that does not interfere with the Transponding pulses that typically phase lock to finish 16 uS before the end of a nominal 58 uS cell. If maximum net coding gain to speed up track packet rates is not required then a simplest embodiment option is for PEP phase changes to not be active from cells 3B to 14B, but used from item A7F onwards.

Since the DCC track voltage is intended to be only two levels, cell timing is simplest and reduces to measuring edge to edge times. A valid received 1-bit cell is in the range of 52 uS to 64 uS and a minimum 0-cell is ~100 uS by DCC rules. Most practical DCC decoders simply discriminate a cell as being half of a '1' if the time is less than ~64 uS, and do not need to pair cell times together for a complete bit duration, which DCC defines as between two edges of the same polarity change. For DCC protocol rules, after SYNC the first instance of a >64 uS cell establishes as the front cell of a '0' bit and this typically determines the track phase/polarity of front cells the decoding device has been connected to. After the '1's of SYNC period, cells 1F to 14B, the Packet start bit 25 is recognized at Zf since it is the first >64 uS pulse after a minimum stream of sync 1-cells. This establishes a DCC front cell starts as high after a rising edge, as in FIG. 2, and establishes the current track connection polarity. The most significant (ms) or bit 7 address byte 26 starts at A7F, as a front cell of a '0' bit. Bit 7 of address byte 26 changes at minimum DCC rule zero period 28 as a shortest PEP front coding, and maximum 0-cell period 29 is shown as the dotted extreme case of PEP 0-cell range. Next, bit 6 address byte 27 is '0', with front cell A6F. Next bit 6 address byte 27 ends at rising edge 32, and shows a maximum front 0-cell PEP period at 31, a dotted minimum front PEP 0-cell at 30. These two address ms zero bits 26 and 27 are represented with no zero-stretching at ~224 uS, for a fixed zero bit time, each with a PEP coding of e.g. 5-bit codes (32 steps of 3 uS) at extreme limit PEP phases. Item 25 may also be used as a secondary and/or alternate PEP reference burst with longer cell times. If the packet number of cells is not even (cell parity) then a DCC coding rule violation can be inferred, and a track packet phase/polarity reversal has likely occurred, and packet polarity will be re-captured at the next Zf event.

Holding a total '1' bit time fixed at 2×58 uS=116 uS means that the maximum DCC compatible available 1-cell PEP range is ~12 uS, and with 1.50 uS steps we can encode 8 phase steps, or 3 PEP bits per DCC '1' bit, making PEP about 4× faster overall. Since most decoders simply decide on a 1-cell maximum of 64 uS value and typically do not need to check the cell lower time bound; if a shorter total 1-cell is now allowed by encoding rules, then more coding rate-gain can be chosen when using just an e.g. 64 uS 1-cell threshold decision point.

Relaxing the track encoding ranges for a DCC 0-cell as simply >(64 uS+ slew time margin), means most existing DCC decoders can accept a wide range of 0-cell timings modified by PEP rules. Note that the '1' and '0' bit encodings do not need to be the same phase step size, and/or number of PEP encoded bits per DCC bit. On a busy layout that needs PEP speedup to address many locomotives it may not be sensible to enable DCC Zero-stretching, since this method of developing a track control DC bias can significantly lower packet rate with long zero-stretches. In contrast to Ireland '368 col 31/line 56 teaching, this new art can run a zero-stretch control method, if the codec logic continuously ratios the cell high/low times, adjusting for prior PEP differences and can modify a nominal '0' front and back cell to maintain desired DC balance. To do this, above a preset maximum '0' cell time (e.g. 250 uS) PEP encoding bits are not encoded but skipped (by being above the allowed coding range), and the cell can then be dynamically extended as needed to give the short term DC balance required to control a DC motor in an analog locomotive.

Actual overlaid PEP bit stream data encodings do not need to follow existing DCC encoding rules and formats, but are configured as continuous PEP bit streams that fit over an underlying or "carrier" DCC or other track packet structure. This is possible since the encoding Command Station knows the track packet data pattern that will be overlaid with any of the possible separate queued PEP data streams to transmit. Scheduling logic in control unit logic 4 that feeds data to protocol codecs 16 can select the best fit queued PEP data to overlay on any DCC packet. In fact it is possible to encode PEP over non-DCC conforming packets that are simply configured to allow the detection of a primary PEP reference burst 22, and that will be rejected by DCC decoders. The example DCC and PEP timings taught may be modified for any practical implementation, and still fall within the scope and spirit of this invention. Determining the PEP coding rules effectively sets the transmit-rate of sequential bits and/or bytes encoded. PEP bit decoding is functionally similar, but more complex than a UART, and employs edge time period measurements combined with analysis/decoding of the overlaid packet protocol to then decode PEP; phase, packet and various reference points to yield two simultaneous data streams and/or command and control channels.

DCC's F/2F encoding is not time efficient or optimal. In particular DCC '0'data bits carry an extra time overhead compared to a PEP 0-bit, and in fact a PEP 0-bit is merely one of the allowed phase values reduced to an encoded PEP bit alphabet, and has no particular coding weight. I.e. an example 16-step phase or four-bit nibble PEP bit alphabet member encoded as '0000' can be assigned to any chosen valid phase value or time period, and all other members in this PEP bit alphabet may be assigned as desired, typically in a value weighted order. Practically, a PEP encoded nibble value like '0000' would be assigned to the; minimum, maximum or middle phase value, depending whether a nibble sign bit is desired.

A superior PEP bit stream encoding method is to employ selective lossless compression by e.g. Huffman or LZW encoding of block or groups of data bits into new code alphabets for PEP phase encoding. This allows high frequency PEP events like data block boundary or SYNC identification to be efficiently encoded. A further improvement is explicit identification of the data block size in bits and/or bytes that avoids wasting time on DCC inter-byte bits. A consideration in selecting a group of available encoding methods is the effect of random track noise or upset events that can occur. Any DCC bit will mostly be mutilated to be shorter by a track short-circuit or voltage dropout event, so detecting short or runt size bits will indicate a problem, that can be recovered from after the next PEP boundary marker or SYNC burst is seen. Since primary PEP reference burst 22 provides a measure of a 1 bit cell pair or same polarity edge to edge time, this can be used in any bit reception and codec logic to reject edges and pulses violating the known valid timing windows. Current track connection polarity is determined at period Zf at the end of each DCC SYNC period. Any track reversal during a packet will cause a format and/or timing violation. For a PEP packet that is more sensitive to edge time changes, continuous evaluation of SYNC and other boundary marker coding points allows validation of each PEP packet with respect to signal disturbances.

There are a number of useful encoded choices of format and/or rules to change for flexibility within any PEP packet, as a "PEP rule setting", encoding values to select items such as; PEP phase step size, PEP encoding phase ranges (or number of PEP bits within both DCC '1' and '0' cells), PEP encoding zones (i.e. identifying any areas not used by PEP in a legacy 'carrier' packet), PEP lossless compression method (chosen for PEP data bits), PEP encoded data block size, PEP bit alphabet (translation of phase value to a bit-group value used), PEP protocol flags (to indicate any PEP protocol variations) and PEP protocol style (what encoded types of control information are present), etc. It is possible to selectively change these current encoded PEP rule settings on a PEP packet by packet basis. Varied PEP rule settings may be chosen statically or sequentially, and as the layout signal and phase jitter performance is analyzed, a choice is made manually or automatically for a best rule and performance match of PEP scheme. This choice can be communicated to all data sink codecs decoding data bits by any method, but one of the best is to use phase steps of the cells from e.g. 1F, 1B, 2F, 2B and 3F as encoded PEP rule setting 21 to encode and broadcast to the tracks a particular rule set to use on this merged e.g. PEP/DCC packet. The encoded PEP rule setting 21 is pre-determined and typically a coarser range of PEP steps, so they can be reliably discriminated in presence of system noise and phase jitter. All the 5 cells of an example encoded PEP rule setting 21 at a fixed 58 uS nominal cell time could e.g. encode the lowest level or most basic PEP rules allowed and maximum DCC compatibility, as a default. The actual bit encoding values of encoded PEP rule setting 21 are grouped to choose a particular configuration from a predetermined menu of choices and combinations, and not all combinations may be required. The actual values of 21 are not included here since they are simply chosen as needed for each embodiment based on PEP performance desired. A Command Station can evaluate the primary layout tracks 11 signal jitter by monitoring local track power connection 8C voltages on a particular installation, so it is able to match the level of PEP phase steps to the local track performance, as is optimal. A layout with higher jitter will select bigger and more noise tolerant PEP steps, giving less net rate-gain, or vice-versa. A Command Station may interrogate other Booster items 2 on the layout (via data network 9) or decoder items 3 (via track data-feedback means) and get a report of their local track signal jitter, so as to then automatically set a PEP rule that will correctly work for all track conditions around the system.

Note that primary PEP reference burst 22 and/or encoded PEP rule setting 21 and/or cell phase coding holdoff period 23 can be configured at; different times, bit combinations, bit timings and/or be overlaid on any other track formats. The key point is these new art mechanisms provide a predetermined method to engineer consistent decoding and synchronization, whilst allowing a track signal to adapt to varying noise and/or performance conditions. For some PEP configurations other digital track formats such as Marklin Trinary or 'AC digital' may be incompatible, or transient 'visiting' decoders may be incompatible and not accept all and/or any PEP overlay methods. For this reason local configuration storage 15 includes the ability to selectively enable and/or disable all aspects of PEP rule setting encoding, including turning PEP off to only allow legacy packet operation. This flexibility allows a single design and software set of the Command Station to support widely varied markets and customer requirements.

A PEP encoding Command Station can perform a redundant low rate DCC refresh echo of basic decoder state information, as a cross-check, whilst sending the primary control data via a PEP coding. PEP capable decoders inherently decode both data streams, and this addition provides an extra and automatic fail-safe control if transient track signal problems occur that upset DCC and/or PEP packets.

FIG. 3A shows a single-ended wired-or example of a wire connection 53 with a single current source termination 54 as part of the electrical network interface embodiment of data network connection 6C; buffering signals between a data network interface 6 and a segment of data network 9. FIG. 3B shows an alternate example of a differential data connection driving a two wire bus 59 with composite termination impedance 58 also shown. Either electrical topology may be used to communicate network data on different segments of data network 9. These FIGS. 3A and 3B items are effectively functional sub-sections of data network interface 6 and data network connection 6C.

A legacy 16.4 KBd LocoNet uses a single-ended approach for simplicity and robustness, and a transmit switch 51 is driven by a codec serial interface 50 to transmit Async NRZ serial bit streams, where the network LOW level is defined when the transmit switch 51 is conducting/ON, and the OFF period or network HIGH is defined by current source termination 54, as the only pull-up or current source on this data wire, at e.g. ~10 mA to ~25 mA. Receive attenuator 52 is present to level-convert and buffer receive data at the required voltage levels to a codec serial interface 50 via bit receive line 70. The network is typically mixtures of star and buses, as shown by additional connections 55. The single-ended wiring employs data wire 61 with a time varying voltage and ground wire 62 as the ground return connected to a ground reference 49. Codec receive and transmit serial functions and octet interface to bit streams are typically implemented with software and/or well-known hardware UART type devices, with configurable features and baud or bit-rates. Common UART device serial formats are Async NRZ coding at the network bit-rate, with defined start bit (LOW level), 8 data bits and a stop bit (HIGH level). A parity bit may be added before the stop bit, more stop bits and even 9 data bits can be used, by consistent convention for any particular embodiment.

The differential embodiment of FIG. 3B also uses two wires 63 and 64 but both are driven with active voltages of opposite voltage levels. A ground reference wire 65 may also be included as an e.g. cable shield etc., but is not strictly required for the differential data transmitter 56 to send, and differential data receiver 57 to accept bit levels developed by drive currents passing through combined termination impedance 58. A LocoNet compatible cable typically employs two paralleled data wire 61 and two paralleled ground wire 62 instances, to lower copper losses and improve connection reliability. It is possible to employ two partial instances of FIG. 3A type circuits in a differential manner for differential transmitting and receiving on the two instances of data wire 61 after removing the paralleling connections. The first 61 instance transmits a normal in-phase signal that all legacy devices can decode as a STD-810 LocoNet data wire 61, the second data wire 61 instance is driven anti-phase and can be received by a differential receiver or comparator second input 75 as an alternate simultaneous signal path that allows more rejection of common mode ground noise. The added receiver logic can also automatically decide which signals are present on data wire 61 circuit(s) present and process them accordingly. So, segments of LocoNet wiring can employ only single-ended or differential embodiments on a segment, or these may be combined on segments. A LocoNet may comprise a single segment or many segments combined by a signal buffering switch and/or repeating means.

Well known CAN and LIN busses and networks typically employ Async bit streams with differential two wire methods with e.g. RS485 signal levels and several distributed termination networks to control transmission reflections on the wires, which have significant transmission line effects at bits rates such as e.g. 125 KBd to 1MBd signal rates. The differential data transmitter 56 is activated to send voltages by transmit activation 66 when the device infers it has sole access to the bus. Typical LocoNet and CAN wiring can use UTP or Shielded Twisted Pair (STP) Telecom and/or Network cables with a characteristic impedance from about ~80 ohms to ~150 ohms, depending on actual wire configuration.

Higher system throughput from increased PEP data rates on the track may require the legacy STD-LocoNet (with a ~60.76 uS bit time) to be overlaid with HI-LocoNet capability for a seamless network speed upgrade. To achieve this the open-collector/drain transmit switch 51 must be modified on new art HI-LocoNet capable devices to be able to drive a LOW to HIGH network bit transition at a faster rise time (e.g. ~1.5 uS). For STD-LocoNet this rate is limited by the ability of current source termination 54 to pull-up and charge the total cable capacitance load of the wires being driven. Bit level voltage rise times on large STD-LocoNet systems can be up to e.g. ~15 uS, or ~25% of the bit time without causing receive problems. In this configuration the corresponding bit fall times are typically ~1.5 uS, since transmit switch 51 is a low on impedance and relatively fast device. Transmitter series drive impedance 60 is optionally included to; improve bit fall time voltage fidelity, to control transmission line voltage reflections and also help limit transmitter currents if a transmitter start collision occurs during network access arbitration and/or any backoff times.

FIG. 4A shows one possible embodiment example of a modified single ended HI-LocoNet electrical network interface that incorporates extra items to selectively improve bit rise time. Time sequenced source driver 68 is configured in combination with transmit switch 51. When transmit switch 51 turns OFF by a LOW level on transmit logic data 72 the gating diodes 77 allow source driver 68 to then source current (without overlap) and drive the bit's now rising edge and network HIGH with additional current from a positive voltage supply 73 in parallel with, and augmenting current source termination 54. Source enable 67 is configured to go LOW (inactive) to selectively disable source driver 68's current sourcing when the device is not transmitting messages requiring any rise time speedup. After CSMA/CD network access arbitration, the first network Async start bit is a transition to network LOW, and during this period source enable 67 is set HIGH on source driver 68's control terminal which allows it to then source current and drive fast rise times or voltage transitions during the following message octet rising edges and high time, without disturbing the already fast fall times of transmit switch 51. After the last high speed format message octet stop bit, all devices honor a pre-determined CSMA/CD network high speed Access Backoff time of a minimum number of fast bit times, during which source enable 67 is made LOW by e.g. software to selectively disable source driver 68 actions from interfering with any other device's subsequent network access at any speed.

FIG. 4B shows an alternate embodiment not requiring fast software intervention for sequencing speedup, by implementing source enable 67 logic drive with the delay gate logic arrangement 78, configured with an RC delay time constant 80 for an e.g. ~3 uS-5 uS source enable 67 HIGH pulse at each HIGH to LOW transition of transmit logic data 72. This current source ON period overlaps for at least the required rise time of network LOW to HIGH transition, and may optionally extend for up to about a bit time or more (but less than Access Backoff time) to ensure added impedance termination during any network transmission reflections from mismatches. This rise time augmentation source may be active in slower STD-LocoNet mode, but source disable logic input 79 is optionally provided so the current source can be turned OFF when not strictly required for speedup, using a logic HIGH level on 79, for the logic combination shown. Source disable logic input 79 may also be used to ensure that the initial access arbitration LOW period does not allow a sink LOW and source HIGH level collision from different network attached devices that may cause high transmit currents to flow. The actual active devices to implement; transmit switch 51, source driver 68, gating diodes 77 and delay gate logic arrangement 78 functions may be any combination of discrete or integrated technology components (bipolar, FET, CMOS etc.), but are represented here with transistors, gates etc. for simplicity. Transmission and logic may be in the polarity shown, or the; polarity, voltage levels and current directions reversed with respect to ground as required for an equivalent implementation. Source drive impedance 74 and source driver 68 effectively set the maximum source current available, configure transmit rise time and also influence transmitter drive impedance. The FIG. 4B shown logic 3-input NOR gate with an open collector output drives the required logic voltages and sequences, and other component configurations can be setup to perform the equivalent source current control functions. This type of embodiment and/or variations allows this faster network interface to have typical rise and fall times in the e.g. ~1 uS to ~1.5 uS range, and using a 25% time margin allows a fast bit time to now be in the range of ~5 uS to 7 uS. This allows an e.g. 10× or more improvement in network speed after suitable components and logic configurations are selected, by those skilled in the arts of electronic design, to provide these types of timing results and control logic.

A HI-LocoNet device can be added with a logical network overlay capability to transmit compatible legacy 16.4 KBd messages and optionally intersperse (based on predetermined internal rules) with new higher bit-rate messages. Existing legacy STD-LocoNet devices that receive-sample at the legacy ~60.76 uS bit-rates will typically see; message format, framing and checksum errors during data messages at the higher bit-rate, comprised of many more bit edges and octets. Most LocoNet message activity is weighted toward short 4 and 6 octet messages, so in most cases a complete HI-LocoNet message at e.g. 10× rate will complete transmission before a STD-LocoNet rate octet has completed sampling, as triggered by the start-bit network LOW edge of the first 10× rate octet. In these cases any HI-LocoNet message completing before the most significant bit of a legacy rate octet (i.e. ~8×60.76 uS=~486 uS) will appear as a possible message start, but without correct format following octets, and so will be ignored by legacy protocol decoding. A further augmentation is to generally align any expected transmitted HIGH stop-bit sample points at 16.4 KBd (configured in time from the very first message start bit falling edge) to fall in higher speed LOW start-bit windows, which will always force an Async receive framing error when sampled at the lower legacy rate. Considering the $B_{ref}$ [reference bit-rate of 60.76 uS for STD-LocoNet] and a new $B_{fast}$ [fast bit-rate] on an N-times faster network, this time relationship becomes:

$$B_{fast}=B_{ref}\times(19/((20\times N)+1))$$

For example, for a 10× faster HI-LocoNet, a fast bit-rate of $B_{fast}$=5.743 uS [and not 6.076 uS] will place an $11^{th}$ fast octet start-bit approximately centered on an expected STD-LocoNet stop-bit sample point, ensuring a framing error. This is a 174.1 KBd fast rate that allows mixing of devices and additionally ensures no false messages are inferred when slower legacy devices encounter supposedly undecipherable high speed messages. Selecting a convenient e.g. 5.75 uS bit time or 173.9 KBd rate [hereinafter rounded to 174 KBd] allows the error sample window to still be within an acceptable range to employ this refinement. Other multiples of N may be pre-selected [e.g. a 9× rate yields 6.37 uS bit time, etc.] and/or transmit octet starts can be time-adjusted by a transmit-timing prediction algorithm, augmenting so as to force legacy device errors at any known legacy stop-bit times. In addition, extra dummy <0x00> octet(s) may be appended as an augmentation to high speed messages to enforce STD-920 LocoNet compatibility, without confusing new HI-LocoNet devices that can follow these required and additional new LocoNet message format requirements and rules for overlay mixed bit-rate operation. Note that a HI-LocoNet fast rate message uses a different bit-rate, and can also employ a different Async configuration, such as 9 data bits, and/or parity, etc. The legacy minimum ~912 uS Collision Backoff and/or BREAK time is employed as a rule for a HI-LocoNet device to also ensure mixed mode compatibility.

As a general format rule, a HI-LocoNet device will reply at the same bit-rate as a message to it that prompts and/or requires a response. This means all new added HI-LocoNet devices should scan the network for receive messages at any possible bit-rate, and in many cases with no a-priori knowledge of the next message type or bit-rate expected. One new art way to achieve this with an example two rate network upgrade overlay is to employ an additional bit receive line 71 into a second UART receiver function configured to receive at the e.g. 174 KBd HI-LocoNet bit-rate and configure the first bit receive line 70 UART receiver at the legacy 16.4 KBd STD-LocoNet rate (or vice-versa). The matching receive-rate UART will be detected as that yielding a valid formatted message, while the mismatched receive-rate UART(s) will provide message errors after network activity, and these results can be interpreted to determine this message's actual bit-rate. Extension beyond two allowed discrete transmit bit-rates is possible with additional UART receivers employing this method.

Since a device has a set of configuration rules and/or context to determine the next required transmitter bit-rate, transmit logic data 72 serial bit stream can be implemented with just a single UART transmitter function, with configuration and baud rate set as required for the known current transmit message bit-rate.

Some automatic baud rate detection schemes for Async networks exist that employ a fixed pre-pended data octet, such as 0x55, to allow a receiver to detect the initial start-bit edge timing and then subsequently update to this inferred bit-rate to allow following octets to be received correctly. While this works to flag a rate change, it is an inferior method to this new art multiple UART receiver method, since; it prepends a minimum of a time-wasting octet to every message, and/or is not inherently backwards compatible with a legacy message format. This new art is applicable when employed for Async networks and signal interfaces other than a specific LocoNet embodiment, as a network multiple transmit bit-rate upgrade overlay method.

With a multiple UART receiver embodiment, during e.g. HI-LocoNet transmission the local STD-LocoNet receive data and status queue can be monitored to ensure that invalid message reception for an external low bit-rate device occurs. If a valid STD-LocoNet octet then forms from sub-sampling the faster bits, it is possible at the HI-LocoNet message conclusion to append an octet that is an augmentation that violates a legacy STD-LocoNet message format rule, to ensure this forming spurious low bit-rate message is rejected by other devices. Transmitting an appended dummy e.g. <0x00> octet at the fast transmit bit-rate is one augmentation. Another is immediately appending a STD-LocoNet transmit-rate octet like <0xFF>, which by STD-LocoNet device message formation rules and logic, forces an immediate message restart and a legacy Access Backoff time of 1,200 uS, which fast devices with different message rules/logic and shorter high speed Access Backoff can then use for message traffic.

Employing more than one UART receiver is one embodiment allowing decoding of all valid interspersed transmit-rate messages that are conveyed on LocoNet. Modern CPU's typically have hardware edge or level change period capture support, and software allows input edge transitions on first bit receive line 70 (inputting all edge periods to be analyzed) to be captured, and the resulting period times and level data to be saved in a buffer. At a message end, partial lapse of an Access Backoff time gives a longer period than any valid octet coding, so the decoding software can then e.g. switch from edge data capture to period analysis, to decode the message in the buffer. Many algorithms may be implemented to perform the message extraction from this period buffer data structure which encapsulates/encodes in period data all transitions seen in the receive data stream.

One algorithm embodiment is 'brute force' and references the initial start bit edge and then scans and samples and interprets implied data levels at bit time ranges in the period buffer data structure iteratively, subtracting time at each valid bit-rate, and determines which iteration yields correctly assembled and framed octets and a valid resulting message. This search and test method is a practical embodiment for a modern fast CPU. To speed up the algorithm and not require calculation of each bit increment time in a measured period of a given level, a period lookup table can be constructed for each rate that analyzes a given period into number of bits and framing and sequence data for assembly into a final message bit pattern result. A further refinement is to first preprocess the period buffer data structure to find the fastest edge times, as likely fastest bit-rate possible, and then make the first sample pass based on this best initial bit time estimate. Missing a valid message can then force continuance with iterative buffer searches. With more than two allowed transmit bit-rates these algorithms can be an effective and compact way to enable multiple transmitted bit-rate message reception. A combination of hardware UART and software octet decoding (particularly for slower bit-rates) may also be employed. Functionally the detection and assembly of formatted message octets at particular transmit bit-rates is intrinsically part of a codec function.

For LocoNet embodiments with signal loading due to excessive wire length, it may be impossible to reliably use the factory-default HI-LocoNet transmit bit-rate. In this case Command Station local configuration storage 15 can be setup manually or automatically to default to other slower rates. Devices can read these configuration settings at STD-LocoNet rate and then adapt their best available high speed bit-rates to conform to these settings.

Since LocoNet is a Peer-to-Peer topology, most legacy devices on the network do not actually need to accept or interpret all message traffic, except after a transmitted transaction that required a response. In this way, spurious or unexpected receive messages are generally ignored unless they occur in the context of a timely anticipated response, exchanged from some other device. A Command Station has to process all messages, since it is a central repository of most control, configuration and/or state information.

A HI-LocoNet device added to an existing system benefits from automatically probing the system speed capabilities. This can take the form of; a request for Command Station configuration and/or system capability information with initial STD-LocoNet messages and responses, and/or additionally probing with a unique high speed probe message that elicits a predetermined response for evaluation. An example of this would be a valid LocoNet <0x81><0x7E> IDLE message sent at 174 KBd fast bit-rate. A new art Command station immediately responds within e.g. ~10 bit times to this with a following: <0x81><0x7E> echo reply at 174 KBd. If this IDLE probe sees an expected response within ~58 uS then the device can be sure that it can converse with a command station in high speed bit mode if desired, and can automatically configure and/or enable any control and/or device functionality this allows, by following preset capability and interoperation rules. An example of this is; for a layout detector and/or signaling device to switch to a preferred highest bit-rate operation on an upgraded system, since most other e.g. throttle devices do not process these message exchanges, but a Command Station maintains state information for layout detection. If there are any repeaters or switches in the data path to the Command Station, this simple and fast ~260 uS total activity, on being connected to the network proves a high speed link can optionally be used at the device's discretion. If the probed devices do not support a high speed reply, on many systems the lack of fast rise time will effectively filter out any possible response, and any connected new device will seamlessly fall back to legacy STD-LocoNet message operations. This probing can be done after e.g. each power up event, so the overall capabilities can update as elements in the system are changed, or devices connected over time at different sections of the layout control system with possible differing transmit bit-rate capabilities.

Large layouts often grow organically, and new devices are added over time. The resulting; connections, signal loads and signal voltages can degrade with these changes and/or time to a point that reliable operating thresholds may not be sustainable. For layouts such as modular club layouts with many transient and/or dynamically changing configurations, additional problems such as; transient unintended multiple Command Stations, signal and power overloads and varying and/or broken connections may occur. This can make it challenging to; setup, debug and maintain operations with many people involved in modifying the configuration. A new art HI-LocoNet embodied Command Station benefits from a new capability to monitor, configure and record any untoward system events and errors, and save this information in interface status storage 17 for later diagnostic retrieval and review.

Probing with a predefined data probe message for detecting any additional active Command Station is performed at power up and/or periodically by e.g. sending a STD-LocoNet 4-octet LocoNet Slot Read message of the Command Station Option Switches (OPSW), or e.g. <0xBB><0x7F><00><3B> message. If one or more specific timely replies are seen, then other Command Station(s) are present that will cause control problems. A Slot Write command back to any Command Station gives access to setting up configuration storage 15. LocoNet defines configuration option-switch bit OPSW #2 as ON/set in configuration storage 15 as disabling the Command Station capability, and hence making the newly probed device a slave Booster only. This new adaptive disabling probe logic can now be automatically employed by the initial and/or higher priority Command Station to write back and force competing units to Boosters only and so avoid the problem of conflicting Command Stations.

For improved system reliability and problem diagnosis there is a need to monitor operating signals and voltage levels such as those encountered at the; data network interface 6, auxiliary control interface 7, and possibly power interface 8 and/or any power supplies for diagnostic evaluation. FIG. 4A network analog voltage sampler 76 can be added to improve data network; stability, service quality and reliability, by enabling sampling of network voltage levels from receive attenuator 52, and monitoring if they are within a valid sampled analog range. Items 70, 71, 75 and 76 are configured for sampling the receive signal through an instance of e.g. 52 or similar means not shown for clarity. Modern CPU/microcontrollers can easily and accurately sample analog voltages with A/D convertors and/or limit comparators in microsecond windows at predetermined times and convert the voltages to digital representations for processing. In particular the DC loads on a single-ended data wire 61, and hence driven by current source termination 54, with no STD-LocoNet data traffic should not be less than a network high minimum of e.g. ~+8V, and a low bit level should not exceed a network low maximum of ~+1.5V, or appropriate voltages and sample timing that match the particular implementation details. These data network measurements may be time scheduled to occur continuously and in synchrony with any network traffic and bit activity, and if the resulting voltages are outside acceptable limits, the Command Station can alert for errors with led lamp indications, audible alarms, and/or save the time and event type in interface status storage 17 for later diagnostic retrieval. This network monitoring and diagnosis logic and method is possible for all types of networks where the voltage levels can be measured and evaluated to be within limit values, and is particularly valuable in model railroad layouts since users benefit from strong error and diagnostic indications. In addition to the data network interface 6, voltages and other interface conditions on; auxiliary control interface 7, power interface 8 and power supplies can be monitored in the same manner for diagnosis.

Therefore, while the disclosed information details the preferred embodiments of the invention, no material limitations to the scope of the claimed invention are intended and any features and alternative designs and/or embodiments that would be obvious to one of ordinary skill in the art are considered to be incorporated herein. Consequently, rather than being limited strictly to the features disclosed with regard to the preferred embodiment, the scope of the invention is set forth and particularly described in the following attached claims.

INDUSTRIAL APPLICABILITY

This invention has industrial applicability in design, manufacturing and support of devices for control systems employing formatted messages at differing rates.

The invention claimed is:

1. A method for combining legacy transmit-rate data with one or more additional differing transmit-rate data conveyed on a model railroad layout control system link, comprising:

(i) said legacy transmit-rate data, (ii) at least one said additional differing transmit-rate data, (iii) conveyed on said model railroad layout control system link, and further comprising;

(iv) a system control device, with at least;

(v) a control unit logic to enable and/or control data flow on said model railroad layout control system link, communicating with a protocol codec configured for processing; a legacy output as encoding and/or decoding of said legacy transmit-rate data, including an additional codec protocol for encoding and/or decoding of said differing transmit-rate data as an additional output, and combining this with said legacy output, whereby said additional codec protocol allows said system control device to combine said legacy and additional outputs such that the transmitted combination of said additional differing transmit-rate data conveyed along with a said legacy transmit-rate data provides codec outputs valid and/or compatible for processing.

2. The method defined in claim 1 wherein said additional codec protocol is configured to process encoding and/or decoding of one or more said differing transmit-rate data in a bidirectional and/or unidirectional manner along with said legacy transmit-rate data on an input link and/or an output link.

3. The method defined in claim 2 wherein the format of said differing transmit-rate data is; faster or slower than, and configured not to interfere with conveyance of said legacy transmit-rate data.

4. The method defined in claim 3 wherein said legacy transmit-rate data and/or said differing transmit-rate data communicates on a network segment by a single-ended and/or differential transmission method.

5. The method defined in claim 4 wherein a UART means is configured to receive said legacy transmit-rate data, and simultaneously one or more additional differing transmit-rate data are received by one or more additional UART means configured to receive at the matched differing transmit-rate or transmit-rates.

6. The method defined in claim 5 wherein one or more additional said UART means is implemented with hardware and/or software means to receive at said matched differing transmit-rate or transmit-rates.

7. The method defined in claim 4 wherein a receive voltage level is measured to be within specification and an alarm state is generated if said voltage level does not meet specification.

8. The method defined in claim 4 wherein formatted messages of differing transmit-rate data have augmentation to ensure format violations and rejection as an invalid format legacy message if decoding is performed as for said legacy transmit-rate data.

9. The method defined in claim 8 wherein said augmentation appends additional message data at said differing transmit-rate or appends additional message data at said legacy transmit-rate.

10. The method defined in claim 4 wherein differing transmit-rate data has a transmit-rate configured and/or a octet start time adjusted, so as overlap a stop bit time with the sampling of a start bit time of a legacy transmit-rate data octet or byte, to ensure generation of a receive framing error rejection as an invalid format legacy message if decoding is performed as for said legacy transmit-rate data.

11. The method defined in claim 4 wherein said single-ended and/or differential transmission method is configured with an additional time and/or pulse duration controlled current source means to selectively speed up a voltage transition on a network segment.

12. The method defined in claim 11 wherein said network segment is on a LocoNet network where said legacy transmit-rate data supports legacy devices and said differing transmit-rate data supports additional devices at differing and/or faster data rates.

13. The method defined in claim 12 wherein a Command Station detects the connection of an additional Command Station by the response to a predefined data probe message and acts to automatically disable said additional Command Station functionality to ensure correct control operation.

14. The method defined in claim 12 wherein a device responding to a request message on said LocoNet transmits a reply message matching the transmit-rate of said request message.

15. The method defined in claim 12 wherein a device attaching to said LocoNet confirms the network speed capability by checking for a message reply to a differing transmit-rate data probe message.

16. The method defined in claim 12 wherein protocol rules for said LocoNet network require use of a legacy Collision Backoff and/or Break time for all transmit-rates used, to ensure compatible mixing of data at all possible transmit-rates.

17. The method defined in claim 11 wherein said current source means is selectively controlled in time to avoid high transmit currents caused by a conflicting transmitter collision during an access arbitration time and/or transmit access backoff time.

18. The method defined in claim 11 wherein said current source means is configured to provide transmitter drive impedance that improves transmission line matching to suppress voltage reflections and/or limits transmitter collision currents.

19. The method defined in claim 3 wherein said additional codec protocol is configured to encode the combination of said differing transmit-rate data as a Phase Encoded Packet (PEP) track packet format, and simultaneously merge and/or overlay this on said legacy transmit-rate data configured as a legacy track packet format, and transmitting this merged combination on said output link, providing a coding rate-gain.

20. The method defined in claim 19 wherein said legacy track packet format is the NMRA DCC track encoding method.

21. The method defined in claim 20 wherein said PEP track packet format is modified dynamically to ensure that zero-stretch functionality of said NMRA DCC track encoding method correctly maintains short term DC balance required to drive a DC motor in an analog locomotive.

22. The method defined in claim 19 with the addition of a primary phase reference means configured at a predetermined position on said legacy track packet format to allow the determination of and/or compensation of phase errors and/or time jitter on said output link.

23. The method defined in claim 22 wherein said determination of phase errors and/or time jitter on said output link permits adjustment of any PEP phase step size to a minimum time, and/or communicating this minimum PEP phase step size with a PEP rule setting encoding, allowing for the greatest possible coding rate-gain.

24. The method defined in claim 22 wherein said primary phase reference means is encoded at a time that is compatible with a track data-feedback means.

25. The method defined in claim 19 with the addition of a PEP rule setting encoding at a predetermined time that configures selection and employment of different coding rules and/or formats for a PEP packet, and communicates this configuration to a decoding device.

26. The method defined in claim 25 wherein said PEP rule setting encoding is capable of communicating at least, values for one or more items selected from the group consisting of; PEP phase step size, PEP encoding phase ranges, PEP encoding zones, PEP lossless compression method, PEP encoded data block size, PEP bit alphabet, PEP protocol flags and PEP protocol style.

27. The method defined in claim 19 wherein device commands communicated by said differing transmit-rate data as a PEP track packet format are redundantly echoed at a lower rate by said legacy track packet format to ensure fail-safe control.

28. An apparatus for combining legacy transmit-rate data with one or more additional differing transmit-rate data conveyed on a model railroad layout control system link, comprising:

(i) said legacy transmit-rate data, (ii) at least one said additional differing transmit-rate data, (iii) conveyed on said model railroad layout control system link, with the addition of;

(iv) a system control device, with at least;

(v) a control unit logic to enable and/or control data flow on said model railroad layout control system link, communicating with a protocol codec configured for processing; a legacy output as encoding and/or decoding of said legacy transmit-rate data, including an additional codec protocol for encoding and/or decoding of said differing transmit-rate data as an additional output, and combining this with said legacy output, whereby application of said additional codec protocol allows said system control device to combine said legacy and additional outputs such that the transmitted combination of said additional differing transmit-rate data conveyed along with a said legacy transmit-rate data provides combined codec outputs valid and/or compatible for processing.

29. The apparatus of claim 28 with a transmitter communicating on said model railroad layout control system link configured with the addition of an additional time and/or pulse duration controlled current source means to selectively speed up one or more voltage transition rates.

30. The apparatus of claim 28 wherein said additional codec protocol is configured to encode the combination of said differing transmit-rate data as a Phase Encoded Packet (PEP) track packet format, and simultaneously merge and/or overlay this on said legacy transmit-rate data configured as a legacy track packet format, and transmitting this merged combination on an output link, providing a coding rate-gain.

31. An apparatus for the decoding of legacy transmit-rate data combined with one or more additional differing transmit-rate data conveyed on a model railroad layout control system link, comprising:

(i) said legacy transmit-rate data, (ii) at least one said additional differing transmit-rate data, (iii) conveyed on said model railroad layout control system link, with the addition of;

(iv) a system control device, with at least;

(v) a control unit logic to enable and/or control data flow on said model railroad layout control system link, communicating with a protocol codec configured for processing; a legacy output as a decoding of said legacy transmit-rate data, including an additional codec protocol for decoding of said differing transmit-rate data as an additional decoding output, and combining this with said legacy output, whereby application of said additional codec protocol allows said system control device to combine said legacy and additional outputs such that the transmitted combination of said additional differing transmit-rate data conveyed along with a said legacy transmit-rate data provides combined decoded outputs valid and/or compatible for processing.

32. The apparatus of claim 31 wherein said additional codec protocol is configured to decode said differing transmit-rate data as a Phase Encoded Packet (PEP).

33. The apparatus of claim 31 wherein said additional codec protocol is configured to decode said differing transmit-rate data as a data network message at differing and/or faster data rates than legacy transmit-rate data network message.

34. The apparatus of claim 33 wherein said data network message is defined as a LocoNet compatible data network format.

* * * * *